US005515700A

United States Patent [19]

Weingarten et al.

[11] Patent Number: 5,515,700

[45] **Date of Patent: *May 14, 1996**

[54] KNITTED FABRIC CONSTRUCTION FOR AN INDUSTRIALLY LAUNDERABLE KNITTED GARMENT

[75] Inventors: Jon Weingarten, Weston; Rod Kosann, Stamford, both of Conn.; Jerry E. Wallace, Statesville; Olin E. Wilson, Wake Forest, both of N.C.; Maura T. Buckley, Glen Ridge, N.J.

[73] Assignee: Burlington Industries, Inc., Greensboro, N.C.

[ * ] Notice: The term of this patent shall not extend beyond the expiration date of Pat. No. 5,467,512.

[21] Appl. No.: 448,820

[22] Filed: May 24, 1995

Related U.S. Application Data

[62] Division of Ser. No. 195,141, Feb. 14, 1994.

[51] Int. Cl.[6] ..... D04B 1/14; A41B 1/00

[52] U.S. Cl. ..... 66/202; 28/100

[58] Field of Search ..... 57/256, 224, 328; 28/100; 8/185, 532; 66/202

[56] References Cited

U.S. PATENT DOCUMENTS

| | | | |
|---|---|---|---|
| 3,660,010 | 5/1972 | Georgoudis et al. | 8/185 X |
| 3,811,131 | 5/1974 | Camarra et al. | 8/185 X |
| 3,811,834 | 5/1974 | Schwemmer et al. | 8/185 X |
| 3,862,224 | 1/1975 | Peterson et al. | 8/185 X |
| 3,891,389 | 6/1975 | Verburg et al. | 8/185 X |
| 3,978,648 | 9/1976 | Yamagata et al. | 57/224 |
| 4,801,303 | 1/1989 | Carlough et al. | 8/532 |
| 5,050,406 | 9/1991 | Strauss et al. | 66/202 X |
| 5,077,126 | 12/1991 | Green | 57/256 X |
| 5,103,626 | 4/1992 | Morrison | 57/328 X |
| 5,243,813 | 9/1993 | Stahlecker | 57/328 |

*Primary Examiner*—John J. Calvert
*Attorney, Agent, or Firm*—Nixon & Vanderhye

[57] ABSTRACT

Fabric suitable for the manufacture of rental shirts that are capable of being industrially laundered are made by air jet spinning an intimate blend of about 50—50 polyester/cotton (having wrapper fibers holding the yarn bundle together), vat dyeing the cotton component of the yarn (and disperse dyeing the polyester component), and then knitting the dyed yarn to produce a fabric with tightly formed stitches. The yarn is also preferably scoured and finished prior to knitting. The knit fabric is preferably made into a rental shirt or like garment, the fabric having a maximum shrinkage of about 8% both in length and width unrestored after five wash and tumble dry sequences per AATCC Test Method 135, a colorfast rating of 4.0 or higher when subjected to AATCC Test Method 61-IIA, has a rating of 4.0 or higher when tested for pilling, and a life expectancy of at least 50 industrial laundering wash-dry-wear cycles.

17 Claims, 2 Drawing Sheets

KNITTED FABRIC CONSTRUCTION FOR AN INDUSTRIALLY LAUNDERABLE KNITTED GARMENT

This is a divisional of application Ser. No. 08/195,141, filed Feb. 14, 1994.

BACKGROUND AND SUMMARY OF THE INVENTION

By far the most common product in the rental shirt industrial laundry market is a four and one-half oz. 65/35 polyester/cotton woven poplin work shirt. This product, in the early 1960s, replaced the 100% woven cotton garments that were the standard in the industry at that time. Attempts have been made to introduce other products into the industrial laundry retail shirt market in the 1980s, but they have either been completely or mostly unsuccessful. While a 80/20 polyester/cotton woven poplin fabric shirt is still being sold, it has poor comfort properties, and is not a significant factor in the market place. Also, attempts were made to market a plaited work shirt with a 100% polyester face and 50/50 polyester/cotton back. However this product was rejected by the industrial laundry rental circuit marketplace including because it was too hot for employees wearing the garment.

Knit shirts are also sold today by rental companies primarily through direct sale. The manufacturers of such shirts, however, do not recommend that the shirts be laundered commercially because of substantial color loss, surface abrasion, and shrinkage. Under industrial laundry conditions, such knit fabrics exhibit significant color loss, excessive shrinkage, abrasion, and pilling, and general breakdown in fabric appearance. Their life expectancy is only half of that of the standard 65/35 polyester/cotton woven poplin shirts, while being 15 to 25% more expensive.

According to the present invention, a knitted fabric has been developed, from which competitive knit garments can be produced which withstand industrial laundering, having a life that compares favorably to the standard 65/35 polyester/cotton woven poplin garment while having good comfort, porosity, and hand properties. The term "industrial laundering" as used in the specification and claims, and as commonly used in the industry, refers to both commercial and hospital industrial laundries, which utilize typical wash temperatures of 145°–165° F., and strong detergent formulas, which include chlorine bleach, and highly alkaline chemicals. These conditions cause conventional knit fabrics to exhibit significant color loss, excessive shrinkage, excessive abrasion and pilling, and general breakdown in fabric appearance so that they have a life expectancy of much less than 50 industrial laundering wash-dry-wear cycles, making them commercially unacceptable.

According to the present invention a knit fabric suitable for making a work shirt for the rental shirt market that is capable of industrial laundering, having a life expectancy of at least 50 industrial laundering wash-dry-wear cycles, is provided. The two primary aspects of the present invention that result in a knitted product capable of industrial laundering while still having acceptable colorfastness, shrinkage, abrasion, pilling, and general fabric appearance qualities, are the use of air jet spun intimate polyester/cotton blend yarns (e.g. about a 50/50 polyester/cotton blend), and vat dyeing the air jet spun yarn with a vat dye, to impart colorfastness to the cotton component thereof; and dyeing the polyester component as well as with disperse dyes. Also important to obtaining a desired shrinkage resistance, as well as to impart other desirable features (such as soil release and wrinkle reduction features), are practicing the knitting to produce tightly formed stitches, scouring the knit fabric, and finishing the fabric.

According to one aspect of the present invention a method of producing a fabric suitable for use as a rental shirt capable of being industrially laundered is provided. The method comprises the steps of substantially sequentially: (a) Air jet spinning an air jet spun intimate polyester/cotton blend yarn, having wrapper fibers holding the yarn bundle together. (b) Vat dyeing the cotton component of the air jet spun yarn with vat dye and, also dyeing the polyester component with disperse dyes. And, (c) knitting the dyed yarn into a fabric suitable for use in the production of a rental shirt capable of being industrially laundered. There also may be the further steps, after step (c), of (d) scouring the knit fabric, and (e) finishing the fabric. Step (d) is practiced to remove any residues left on the yarn after the practice of steps (b) and (c) while step (e) is practiced to impart soil release, wrinkle reduction, and shrinkage resistance properties to the fabric.

Step (c) is practiced to knit the fabric with tightly formed stitches. The designation "tightly formed stitches" in the knitting art has a specific meaning, although the meaning varies numerically depending upon the particular knitting construction utilized. Anything tighter than 35 stitches per inch on jersey fabrics and 38 stitches per inch on pique constructions is considered "tightly formed stitches". Other types of knitting have different numerical values.

The method steps (a) through (e) according to the present invention are practiced to produce a fabric which shrinks a maximum of about 8% both in length and width unrestored after five wash and tumble dry sequences per AATCC Test Method 135, has a colorfastness rating of 4.0 or higher when subjected to AATCC Test Method 61-IIA, has a rating of 4.0 or higher when tested for pilling using ASTMD3512 Resistance to Pilling, Random Tumble test method, and a life expectancy of at least 50 industrial laundering wash-dry-wear cycles.

Step (a) is typically practiced to produce a substantially 50—50 intimate polyester/cotton blend air jet spun yarn. Step (e) is typically practiced using a first pass using substantially only hot water, and a second pass using a finish formula containing a glyoxal- based resin, a polyethylene slightly cationic softener, a non-ionic alcohol ethoxyolate wetting agent, and a non-ionic fluorochemical stain release agent. There is also typically the further step, between steps (a) and (b), of winding the undyed yarn onto a dye package. The dyes typically used to dye the cotton component are vat black 16, vat brown 1, vat green 1, vat green 3, vat red 13, vat yellow 2, or vat blue 55 dye. Step (b) is typically also further practiced using disperse dyes at the same time as vat dyeing takes place, or in a different dyeing process, the disperse dyes dyeing the polyester component of the intimate polyester/cotton blend air jet spun yarn.

The invention also relates to making a garment capable of being industrially laundered, with the knitted fabric produced by the steps set forth above (typically after scouring and finishing). The garment has a life expectancy of at least 50 industrial laundering wash-dry-wear cycles.

The invention also relates to a knit fabric and garment made therefrom. The knit fabric according to the invention is formed of air spun yarn knit with tightly formed stitches, and is capable of being industrially laundered. The garment shrinks a maximum of about 8% both in length and width unrestored after five wash and tumble dry sequences, has a colorfastness rating of 4.0 or higher when subjected to AATCC Test Method 61-IIA, has a rating of 4.0 or higher when tested for pilling using ASTMD3512 Resistance to Pilling, Random Tumble test method, and has a life expectancy of at least 50 industrial laundering wash-dry-wear cycles. The garment typically comprises a shirt, and the air jet spun yarn is typically an approximately 50—50 polyester-cotton intimate blend having a pique or a jersey knit construction.

It is the primary object of the present invention to produce a fabric for use in making work shirt, or like garment, capable of being industrially laundered, yet having a knit construction, with good comfort, hand, colorfastness, and shrinkage resistance properties. This and other objects of the invention will become clear from an inspection of the detailed description of the invention and from the appended claims.

DETAILED DESCRIPTION OF THE DRAWINGS

Figure 1:
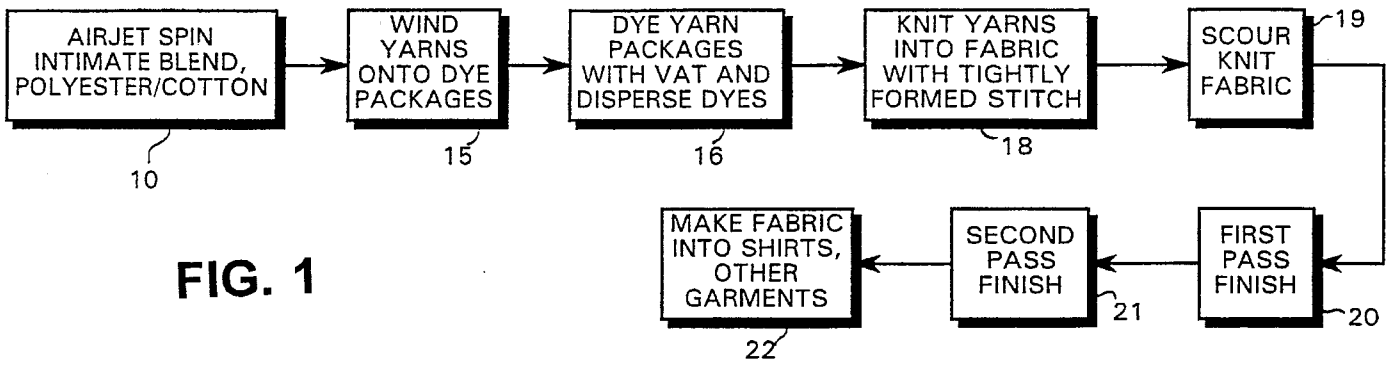
FIG. 1 is a box diagram of an exemplary method according to the present invention.
Figure 2:
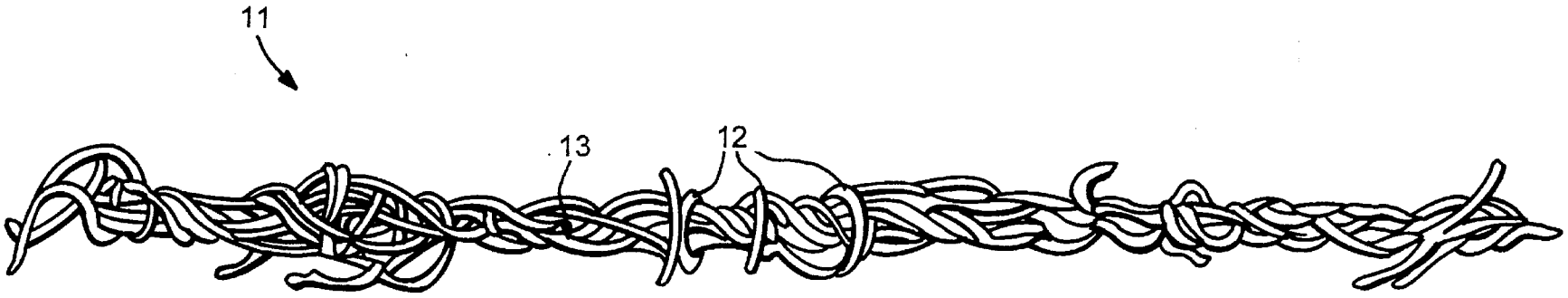
FIG. 2 is an enlarged schematic view showing an exemplary air jet spun yarn that is utilized in the practice of the present invention.

FIG. 1 schematically illustrates an exemplary method according to the present invention for producing a knitted fabric for making a work shirt, or like garment, capable of being industrially laundered and having acceptable comfort, porosity, and hand properties. The first step in the practice of the method of FIG. 1 is the air jet spinning of an intimate blend polyester/cotton yarn, and is indicated at box 10 in FIG. 1. Although other blends may be utilized, an approximately 50—50 polyester/cotton intimate blend is particularly desirable. An exemplary air jet spun yarn that is utilized according to the present invention is shown generally by reference numeral 1i in FIG. 2, the air jet spun yarn 11 being produced utilizing conventional air jet spinning equipment. The air jet spun yarn 11 has wrapper fibers 12 which hold the fibers of the main yarn bundle 13 together, allowing minimal fiber escape, and thus minimizing work-up and pilling compared to conventional ring spun or open end spun yarns. For example a 20-1 50/50 polyester/cotton intimate blend, may be provided.

After spinning, the yarn 11 is then wound onto dye packages, as indicated by step 15 in FIG. 1, and then the yarn packages are dyed with a mixture of vat and disperse dyes using conventional dyeing techniques, as indicated by box 16 in FIG. 1. Exemplary vat dyes that can be utilized are: vat black 16, vat brown 1, vat green 1, vat green 3, vat red 13, vat yellow 2, or vat blue 55 dye. Vat dyes are absorbed by cotton fibers when the dye molecules are in the soluble state. Upon chemical oxidation, the vat dyes are converted to their original water insoluble form, whereupon the dyes become insoluble color pigments imbedded within the cotton fibers, exhibiting superior wash fastness compared to other dyes. Advantages of vat dyes compared to other dyes are: (a) Excellent wash fastness, even when washing at a boil with alkali. (b) Improved cold water bleed. (c) Good fastness to heavy industrial laundry. (d) Good resistance to chlorine and peroxide bleaching. (e) Good light fastness, (f) Good resistance to perspiration; and (g) minimal shade change with resin finishing.

Disperse dyes are used at the same time to dye the polyester component of the blend yarn. An exemplary dye procedure for the polyester/cotton intimate blend yarn according to the invention is as follows: Load the yarn packages into a package dyeing machine. Add chemicals (disperse dyes for polyester and vat dyes for cotton). Adjust the liquid volume to high level. Heat to 120° F. and hold for five minutes. Heat to 160° F. at maximum rate. Heat to 190° at 20° F. per minute. Heat to 265° F. at 1° F. per minute and hold for 20 minutes. Cool to 170° at 3° F. per minute and hold for five minutes. Dose add caustic soda and sodium hydrosulfite. Heat to 170° at 3° F. per minute and hold for 20 minutes. Cool to 140° F. at 2° F. per minute and hold for 20 minutes. Dose add solid salt. Heat to 140° F. at 2° F. per minute and hold for 30 minutes. Cool to 120° F. at 2° F. per minute. Overflow rinse at 90° F. for 20 minutes. Fill the machine to a high level. Dose add chemicals. Heat to 90° F. and hold for 10 minutes. Heat to 140° F. at maximum rate and hold for 10 minutes. Drain the bath. Fill the machine to the high level. Heat to 195° F. at the maximum rate and hold for 10 minutes. Drain the bath. Overflow rinse at 100° F. for 10 minutes. Fill the machine to the high level. Heat to 120° F. at maximum rate and hold for five minutes. Drain the bath; and unload the yarn packages.

After dyeing, the yarn is knit into fabric with tightly formed stitches, as indicated by box 18 in FIG. 1. The term "tightly formed stitch" as used in the knitting art, and in this disclosure and claims, refers to anything tighter than 35 stitches per inch on jersey fabrics, and 38 stitches per inch on pique constructions. The definition of tightness for other knit constructions is different than for jersey or pique. For example an interlock knit construction is considered to have a tightly formed stitch at 32 to 34 stitches per inch. It is desirable for the knit construction to result in a finished fabric weight of 9 to 11 ounces per linear yard to produce the work shirts according to the present invention.

After knitting, the fabric is preferably subjected to a scouring step, as indicated schematically at 19 in FIG. 1. A typical scouring procedure, which is utilized to remove any residues left on the yarn after the dyeing and knitting steps, may be practiced as follows:

A jet machine is filled with water, and two grams per liter of a non-ionic detergent (such as "Topscour FFJ" sold by Top Tex South, Inc. of Charlotte, N.C.)is added, and the fabric is loaded at 80° F. bath temperature. The bath is then heated to 140° F. at 3° F. per minute temperature rise, and the machine is run for 30 minutes at 140° F. Then the bath is drained, the jet machine is filled with cool water, and rinsed for 10 minutes. The scoured cloth is then unloaded.

After step 19, the fabric is passed to a finishing procedure. In one exemplary finishing procedure according to the present invention there is a first pass finish indicated schematically at 20 in FIG. 1, and then a second pass finish indicated schematically at 21 in FIG. 1. The first pass finish 20 may be made using only water while in the second pass finish, 21, a finish formula is utilized so as to provide soil release properties to the fabric to minimize staining from different types of soil, while at the same time reducing wrinkling during the washing and drying, improving shrinkage resistance, and providing softeners to give the final fabric produced a better hand while reducing the possibility of needle cutting during the garment sewing process. One exemplary formula that may be utilized is 18.0% by weight of a glyoxal-based resin (such as Sedgerez 804 available from Sedgefield Specialties of Greensboro, N.C.), about 6% by weight of a polyethylene, slightly cationic softener (such as "Sedgesoft RPS", also available from Sedgefield), about 0.2% by weight of a non-ionic alcohol ethoxyolate wetting agent (such as Sedgemul 91-6, also available from Sedgefield), and about 3% by weight of a non-ionic fluorochemical stain release agent (such Scotchgard FC-248, available from 3M Protective Chemical Products Division, St. Paul, Minn.). The remaining approximately 72.8% by weight of the formula is water.

Figure 3:
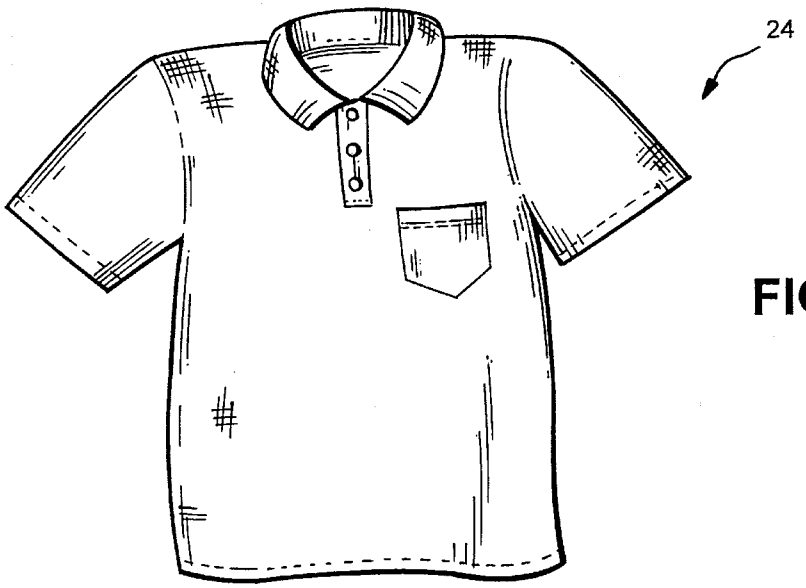
FIG. 3 is a perspective view of an exemplary work shirt produced from the knitted fabric according to the present invention.

After finishing at stage 21, the fabric is made into work shirts and other garments, as indicated schematically at 22 in FIG. 1, utilizing conventional manual, automatic, or combined manual and automatic garment construction, cutting and sewing techniques. An exemplary work shirt produced from the fabric according to the present invention is illustrated schematically at 24 in FIG. 3.

The fabric produced according to steps 10, 15, 16, 18, 19, 20 and 21 of FIG. 1, and the garment 24 produced from the fabric, have minimal shrinkage (maximum shrinkage resistance), acceptable colorfastness, acceptable length, resistance to abrasion and pilling, and a life expectancy of at least 50 industrial laundering wash-dry-wear cycles. The fabric and garment 24 shrink a maximum of about 8% both in length and width unrestored after five wash and tumble dry sequences per AATCC Test Method 135, have a colorfast rating of 4.0 or higher when subjected to AATCC Test Method 61-IIA, and have a rating of 4.0 or higher when tested for pilling using ASTMD 3512 resistance to pilling, random tumble test method. The garment 24 has good comfort and hand properties, and is competitive with the 65/35 polyester/cotton woven poplin garments dominant in the industrial laundry rental shirt market.

It will thus be seen that according to the present invention an exemplary, method of producing a knitted fabric, and of producing a knit garment from that fabric, are provided having numerous advantageous properties and features. While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent methods and products.

What is claimed is:

1. A method of producing a fabric for use as a garment being industrially laundered, comprising the steps of substantially sequentially:

(a) air jet spinning an air jet spun intimate polyester/cotton blend yarn, having wrapper fibers holding the yarn bundle together;

(b) vat dyeing the cotton component of the air jet spun yarn with vat dye, and dyeing the polyester component; and (c) knitting the dyed yarn into a fabric for use in the production of a rental shirt being industrially launderable for at least 50 wash-and-wear laundry cycles.

2. A method as recited in claim 1 comprising the further steps, after step (c), of: (d) scouring the knit fabric, and (e) finishing the fabric.

3. A method as recited in claim 2 wherein step (e) is practiced to impart soil release, wrinkle reduction, and shrinkage resistance properties to the fabric.

4. A method as recited in claim 3 wherein step (e) is practiced using a first pass using substantially only hot water, and a second pass using a finish formula containing a glyoxal-based resin, a polyethylene slightly cationic softener, a non-ionic alcohol ethoxyolate wetting agent, and a non-ionic fluorochemical stain release agent.

5. A method as recited in claim 3 wherein step (d) is practiced to remove any residues left on the yarn after the practice of steps (b) and (c).

6. A method as recited in claim 5 wherein step (c) is practiced to knit the fabric with tightly formed stitches.

7. A method as recited in claim 6 wherein step (c) is further practiced to produce a pique or a jersey fabric construction.

8. A method as recited in claim 1 wherein step (a) is practiced to produce a substantially 50—50 intimate polyester/cotton blend air jet spun yarn.

9. A method as recited in claim 8 wherein steps (a) through (c) are practiced to produce a fabric having a finished fabric weight of 9 to 11 ounces per linear yard.

10. A method as recited in claim 1 comprising the further step (a'), between steps (a) and (b), of winding the undyed yarn onto dye packages.

11. A method as recited in claim 10 wherein step (b) is practiced using vat black 16, vat brown 1, vat green 1, vat green 3, vat red 13, vat yellow 2, or vat blue 55 dye, for the cotton component, and disperse dye for the polyester component.

12. A method as recited in claim 1 wherein step (b) is further practiced using disperse dye for the polyester component at the same time as vat dyeing takes place.

13. A method as recited in claim 1 comprising the further step of making the knit fabric into shirts.

14. A method as recited in claim 1 wherein steps (a) through (c) are practiced to produce a fabric having a finished fabric weight of 9 to 11 ounces per linear yard.

15. A garment being industrially launderable, produced by the steps of substantially sequentially:

(a) air jet spinning an air jet spun intimate polyester cotton blend yarn, having wrapper fibers holding the yarn bundle together;

(b) vat dyeing the cotton component of the air jet spun yarn with vat dye, and also dyeing the polyester component;

(c) knitting the dyed yarn into a fabric; and (d) making the fabric into a garment having a life expectancy of at least 50 industrial laundering wash-dry-wear cycles.

16. A garment as recited in claim 15 wherein the garment is made by the further steps, between steps (c) and (d), of: (e) scouring the knit fabric, and (f) finishing the fabric.

17. A garment as recited in claim 15 wherein the garment is further made by practicing step (f) to impart soil release, wrinkle reduction, and shrinkage resistance properties to the fabric, and by practicing step (e) to remove any residues left in the yarn after the practice of steps (b) and (c); and by practicing step (c) to knit the fabric with tightly formed stitches.

* * * * *